US009457566B2

(12) United States Patent
Kuroda et al.

(10) Patent No.: US 9,457,566 B2
(45) Date of Patent: Oct. 4, 2016

(54) LIQUID EJECTING HEAD AND SUPPORT MEMBER

(71) Applicant: CANON KABUSHIKI KAISHA, Tokyo (JP)

(72) Inventors: Tomotsugu Kuroda, Yokohama (JP); Yukuo Yamaguchi, Tokyo (JP); Kiyomitsu Kudo, Machida (JP); Satoshi Kimura, Kawasaki (JP); Naoko Tsujiuchi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/721,311

(22) Filed: May 26, 2015

(65) Prior Publication Data

US 2015/0343767 A1 Dec. 3, 2015

(30) Foreign Application Priority Data

May 30, 2014 (JP) ..... 2014-112736
Apr. 6, 2015 (JP) ..... 2015-078008

(51) Int. Cl.
*B41J 2/14* (2006.01)

(52) U.S. Cl.
CPC ..... *B41J 2/14024* (2013.01)

(58) Field of Classification Search
CPC ..... B41J 2/1408; B41J 2/1433; B41J 2/14; B41J 2/14024
USPC ..... 347/44
See application file for complete search history.

(56) References Cited

U.S. PATENT DOCUMENTS

| | | | | |
|---|---|---|---|---|
| 5,888,333 | A | 3/1999 | Ono et al. | |
| 6,659,595 | B2 | 12/2003 | Yamaguchi et al. | |
| 6,824,243 | B2 | 11/2004 | Yamaguchi et al. | |
| 6,957,883 | B2 | 10/2005 | Yamaguchi et al. | |
| 7,070,267 | B2 | 7/2006 | Yamaguchi et al. | |
| 7,712,870 | B2 * | 5/2010 | Shibata | B41J 2/14 347/50 |
| 8,052,251 | B2 | 11/2011 | Kudo et al. | |
| 8,100,505 | B2 | 1/2012 | Kuroda et al. | |
| 8,246,141 | B2 * | 8/2012 | Petruchik | B41J 2/14024 347/20 |
| 8,955,931 | B2 | 2/2015 | Takahashi et al. | |
| 9,033,457 | B2 | 5/2015 | Oikawa et al. | |
| 2009/0309923 | A1 | 12/2009 | Saikawa et al. | |

FOREIGN PATENT DOCUMENTS

| | | | |
|---|---|---|---|
| CN | 101073944 | A | 11/2007 |
| CN | 101563231 | A | 10/2009 |
| JP | 2010046853 | A | 3/2010 |

OTHER PUBLICATIONS

Office Action dated Jul. 6, 2016 in Chinese Patent Application No. 201510290324.8.

* cited by examiner

*Primary Examiner* — Julian Huffman
*Assistant Examiner* — Michael Konczal
(74) *Attorney, Agent, or Firm* — Fitzpatrick, Cella, Harper & Scinto

(57) ABSTRACT

There are provided a liquid ejecting head and a support member that can achieve both of breakage avoidance of a print element substrate and deformation suppression of the support member. Therefore a plate thickness of an adhesion part in the support member is thinner that a plate thickness of a main surface other than the adhesion part.

10 Claims, 7 Drawing Sheets

PRIOR ART

PRIOR ART

PRIOR ART

LIQUID EJECTING HEAD AND SUPPORT MEMBER

BACKGROUND OF THE INVENTION

1. Field of the Invention

The present invention relates to a liquid ejecting head that ejects liquids, and a support member.

2. Description of the Related Art

A liquid ejecting head used in a liquid ejecting device ejects liquids (ink) onto a print medium for printing. The liquid ejecting head is configured primarily of a print element substrate that ejects ink, a support member that supports the print element substrate, a housing that introduces ink to the support member from an ink tank, and a flow passage plate that forms flow passages integrally with the housing. Resistance heating elements are disposed on the print element substrate to apply heat to ink for ejection, and electricity is applied selectively to the resistance heating elements according to print data. Therefore there are some cases where a temperature of the print substrate element rises due to heat of the resistance heating element during printing, which provides an adverse influence on an image. For solving the above problem, in the conventional art, alumina having high heat radiation properties is used as a material for the support member for reducing a temperature rise of the print substrate element during the printing (Japanese Patent Laid-Open No. 2010-046853).

However, ink improved for commercial purposes, such as ink that has overcome water-resistant properties and marker-resistant properties that are weak points in ink conventionally used, has recently been developed. Viscosity of ink becomes high as a result of the development of such ink. It is usually required to warm ink for low viscosity to eject the highly viscous ink, but it is difficult to preliminarily stabilize a temperature of ink in a short time before ejection, for example, since the warmed ink is more likely to be cooled in the support member using the alumina. That is, in the conventional liquid ejecting head using the alumina in the support member, the kinds of the ink that can be selected are limited.

Therefore, it is considered to enhance heat-retaining performance of the print element substrate by changing the material of the support member to a resin having lower heat conductivity as compared to the conventional alumina. However, in a case of applying the configuration of the conventional support member without alteration to be changed to a resin, there occurs a crack of the print element substrate due to expansion/contraction of the resin in the process of bonding and fixing the print element substrate.

SUMMARY OF THE INVENTION

Accordingly, the present invention provides a support member that is formed of a resin material and suppresses an adverse effect due to expansion/contraction of the support member on a print element substrate to be mounted thereon, and a liquid ejecting head provided with the support member.

Therefore, a liquid ejecting head according to the present invention comprises a print element substrate that can eject liquids from ejection ports, and a support member that supports the print element substrate by causing the print element substrate to adhere to an adhesion surface of an adhesion part, wherein the support member is formed of a resin material and a thickness of the adhesion part is thinner than a thickness of an outer edge part of the support member.

According to the present invention, the liquid ejecting head is configured to have the plate thickness of the adhesion part in the support member that is thinner than a plate thickness of a main surface other than the adhesion part. As a result, the liquid ejecting head and the support member that can achieve both of breakage avoidance of the print element substrate and deformation suppression of the support member can be realized.

Further features of the present invention will become apparent from the following description of exemplary embodiments (with reference to the attached drawings).

BRIEF DESCRIPTION OF THE DRAWINGS

FIG. 2D is a sectional view taken in a direction of arrows IID-IID in FIG. 2C;

DESCRIPTION OF THE EMBODIMENTS

First Embodiment

Hereinafter, embodiments according to the present invention will be in detail described with reference to the accompanying drawings.

Figure 1A:
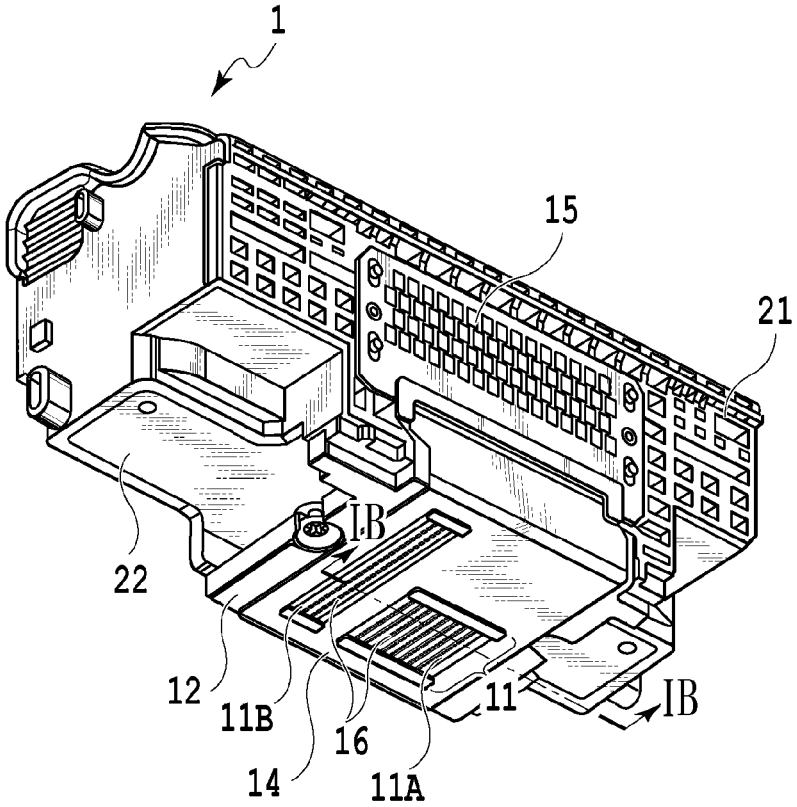
FIG. 1A is a perspective view illustrating a liquid ejecting head according to a first embodiment in the present invention.
Figure 1B:
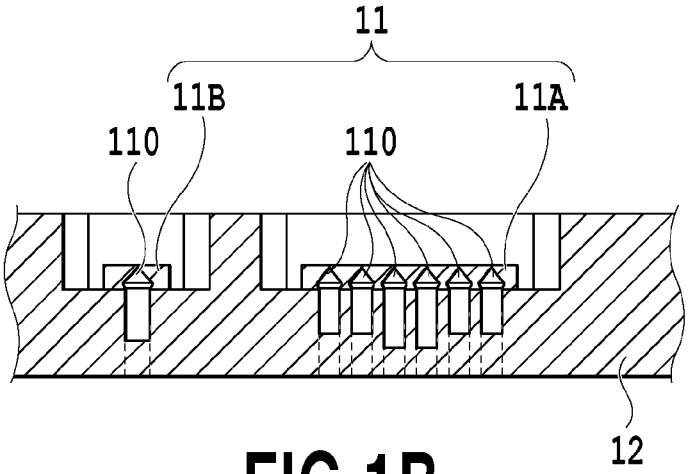
FIG. 1B is a sectional view taken in a direction of arrows IB-IB in FIG. 1A.

FIG. 1P, is a perspective view illustrating a liquid ejecting head 1 to which a liquid ejecting head in the present invention can be applied, and FIG. 1B is a sectional view taken in a direction of arrows ID-ID in FIG. 1A. The liquid ejecting head 1 is configured of two print element substrates 11A, 11B as liquid ejecting substrates, a support member 12, an electrical wiring member 14, an electrical contact substrate 15 (electrical wiring substrate), a housing 21, a flow passage forming member 22, a joint member (not shown), and the like. The print element substrate 11A is formed of an Si substrate having a thickness of 0.725 mm and provided with six rows of first ink supply openings that are long groove-shaped through openings as ink flow passages.

One row of electrothermal conversion elements is disposed to line up at each side of the ink supply opening, and electrical wiring made of Al and the like for supplying electric power to the electrothermal conversion elements is further formed. The electrothermal conversion element and the electrical wiring are formed by a film formation technique. The print element substrate 11B is provided to be separated from the print element substrate 11A, in parallel thereto. As to a material of the print element substrate 11B, it is formed of an Si substrate of 0.725 mm in the same way as that of the print element substrate 11A, and is provided thereon with one row of a first ink supply opening that is a long groove-shaped through opening as an ink flow passage.

The electrothermal conversion elements on each of the print element substrates are arranged in a zigzag manner in each row to interpose the ink flow passage therebetween. That is, positions of ejection ports 16 in each row are disposed to be shifted not to overlap with each other in a direction vertical to the lining row direction. Further, electrode parts that supply electrical power to the electrical wiring connected to the electrothermal conversion elements are formed to be arranged along sides of the electrothermal conversion element at both the outer sides. On a surface of the Si substrate on which the electrode part and the like are formed, an ink flow passage wall provided with ink flow passages corresponding to the electrothermal conversion elements and a ceiling part that covers its upper side are provided.

The ejection ports 16 are opened to the ceiling part as the structure made of a resin material and formed by a photolithographic technique. The ejection ports 16 are provided on a surface of the print element substrate 11 on which the ejection ports are provided, facing the electrothermal conversion elements and forming an ejection port row. Ink supplied from the ink flow passage is ejected from the ejection port 16 facing each of the electrothermal conversion elements by pressures of air bubbles generated by heating each of the electrothermal conversion elements.

The electrical wiring member 14 serves to form an electrical signal path through which an electrical signal is applied to eject ink (be capable of ejecting ink) to the print element substrate 11. The electrical wiring member 14 is provided with opening parts formed to correspond to the respective print element substrates 11. An electrode terminal connected to each of the electrode parts of the print element substrates 11 is formed near an edge of the opening part. An electrical terminal connecting part is formed on an end part of the electrical wiring member 14 to establish electrical connection to the electrical contact substrate 15 having an external signal input terminal for receiving an electrical signal, and the electrode terminal and the electrical terminal connecting part are connected through a continuous, beaten-copper wiring pattern.

The electrical connection between the electrical wiring member 14 and the print element substrate 11 is established, for example, by bonding the electrode part of the print element substrate 11 and the electrode terminal of the electrical wiring member 14 by a thermal ultrasonic bonding method. An electrical connection part between the electrical wiring member 14 and the print element substrate 11 is sealed by a first sealant and a second sealant. This sealing protects the electrical connection part from corrosion due to ink and an external impact. This first sealant is used primarily for the sealing of the connecting part between the electrode terminal of the electrical wiring member 14 and the electrode part of the print element substrate 11 from the backside and for the sealing of an outer peripheral section of the print element substrate, and the second sealant is used for the sealing of the connecting part from the front side.

The electrical contact substrate 15 is connected electrically to the end part of the electrical wiring member by thermal-compression bonding using an anisotropic conductive film. The electrical contact substrate 15 is provided with terminal positioning holes for positioning and terminal connecting holes for fixation. The joint member is formed of a rubber material having a small compression set. The joint member is tightly held to be compressed between the support member 12 and the flow passage forming member 22, making it possible to reduce a possibility that ink leakage occurs in a communicating part between the ink supply opening and an ink introduction opening.

(Characteristic Configuration)

Figure 2A:
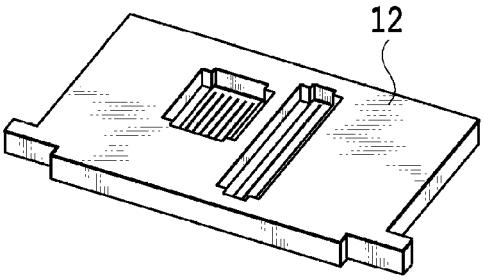
FIG. 2A is a perspective view illustrating a front surface of a support member of the liquid ejecting head.
Figure 2B:
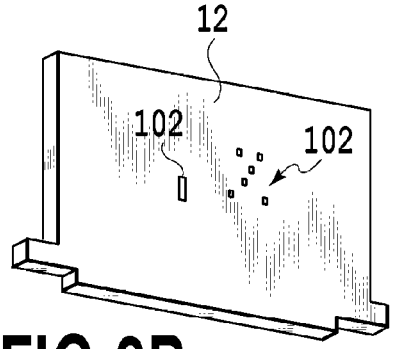
FIG. 2D is a perspective view illustrating a back surface of the support member of the liquid ejecting head.
FIG. 2C is a front view illustrating the support member of the liquid ejecting head.
FIG. 2E is an enlarged sectional view illustrating a β part in FIG. 2D.
Figure 2C:
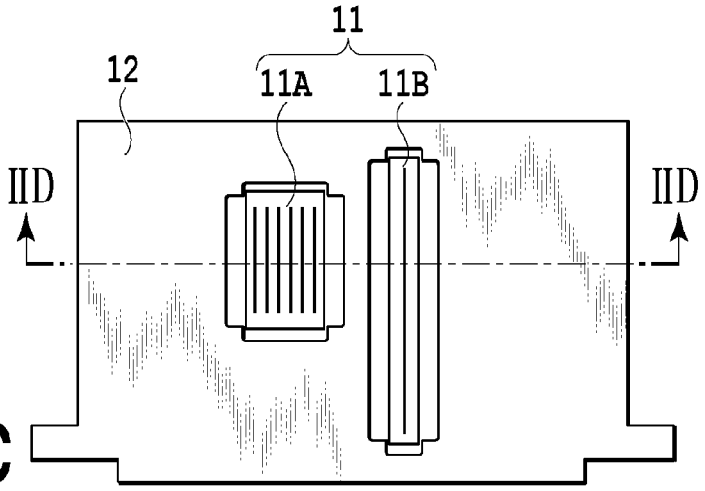
Figure 2D:
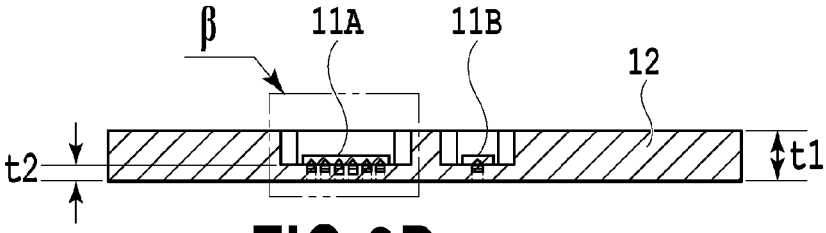
Figure 2E:
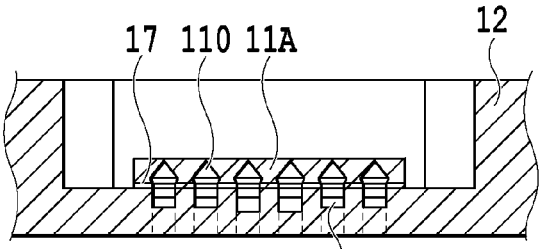

FIG. 2A to FIG. 2E are drawings illustrating the support member 12 that is a plate-shaped support substrate of the liquid ejecting head in the present embodiment. FIG. 2A is a perspective view illustrating a front surface of the support member 12, and FIG. 2B is a perspective view illustrating a back surface of the support member 12. FIG. 2C is a front view illustrating the support member 12, FIG. 2D is a sectional view taken in a direction of arrows IID-IID in FIG. 2C, and FIG. 2E is an enlarged sectional view illustrating a β part in FIG. 2D. The support member 12 to which the print element substrates 11 (11A, 11B) adhere and are supported is made of a resin material, and is formed in a desired shape by injection molding. It is preferable that a difference in linear expansion between the resin material in use for the support member 12 and Si as the material of the print element substrate 11 is as small as possible. Here, a modified PPE resin of PPS/PPE is used as the resin material, and fillers are mixed therein as needed for reducing a coefficient of linear expansion.

The support member 12 is provided with a plurality of second ink supply openings 102 that guide ink to the print element substrate 11, and the support member 12 and the print element substrate 11 adhere and are fixed to each other with accuracy such that the ink supply openings of each other (ink supply openings 110 and second supply openings 102) are communicated to each other. With this configuration, ink can be supplied from the second ink supply opening 102 to the ink supply opening 110. Preferably an adhesive 17 used in adhesion has a low viscosity and a low cure temperature is cured for a short time, and has ink resistant properties. In the present embodiment, a thermosetting adhesive having an epoxy resin as a primary component is used as the adhesive 17, and a thickness of an adhesion layer thereof is set to 85 μm.

Figure 3A:
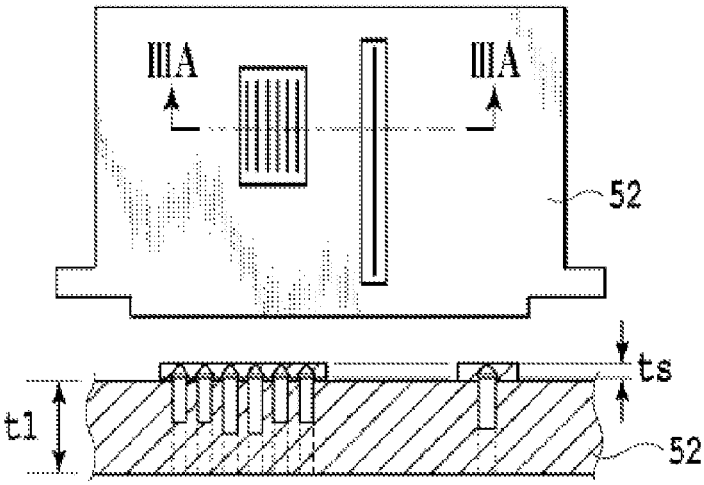
FIG.3A PRIOR ART
FIG. 3A is a front view illustrating a support member in a comparative example and a sectional view taken in a direction of arrows IIIA-IIIA in the front view.
Figure 3B:
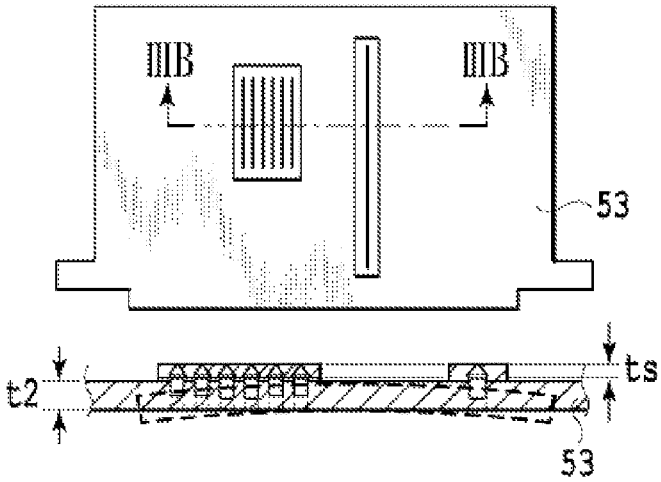
FIG.3B PRIOR ART
FIG. 3B is a front view illustrating a support member in a different comparative example and a sectional view taken in a direction of arrows IIIB-IIIB in the front view.
Figure 3C:
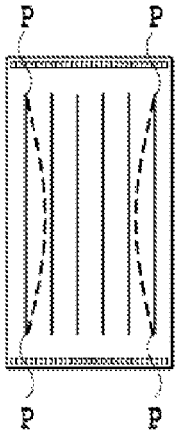
FIG. 3C is a drawing illustrating a state where a print element substrate contracts in the comparative example.

FIG. 3A and FIG. 3B are drawings in comparative examples for explaining the problem in the present invention, and each of a support member 52 and a support member 53 in the respective figures is formed of a resin material. FIG. 3A is a front view and a sectional view illustrating the support member 52 having a thickness of t1, and FIG. 3B is a front view and a sectional view illustrating a support member 53 having a thickness of t2. FIG. 3C is a drawing illustrating a state where a print element substrate is deformed due to contraction of the support member. The support member 52 in FIG. 3A has the thickness of t1 that is sufficiently thicker than a plate thickness of is of the print element substrate. For bonding the support member 52 having the plate thickness of t1 and the print element substrate 11, the heat-curable adhesive is heated and cured and eventually cools which will be back to room temperature. At this time, since a linear expansion coefficient of the support member 52 is larger than that of the print element substrate 11, the support member 52 largely contracts. Therefore tension is loaded on the print element substrate 11, and each of the supply openings that are provided to be linearly in parallel on the print element substrate 11 is largely deflected to the inside as shown in a broken line illustrated in FIG. 3C. Accordingly, each of the supply openings is subjected to tension stress. This tendency is more remarkable toward the outside from a center of the print element substrate 11, and particularly the stress to be loaded on four corner parts P positioned in the outermost row becomes larger than that of the other row. There are some cases where when the tension stress loaded on the corner part P of the supply opening exceeds an allowance amount of the Si material, a crack occurs from that spot as a starting point.

On the other hand, as the support member 53 as illustrated in FIG. 3B, also in a case where the plate thickness is made to the plate thickness of t2 that is as nearly thin as the plate thickness is of the print element substrate 11 in the same way as the support member 53, when the heat-curable adhesive is heated and is bonded for fixation, and thereafter, is back to room temperatures, the support member 53 is deformed. However, as compared to FIG. 3A, the thickness of the support member 53 is thinner and the surface strength of the support member 53 itself is relatively weak. Therefore the deformation state of the support member 53 is different from that of FIG. 3A. Specifically since a face of the support member 53 at a print element substrate side is fixed by the adhesive, it contracts less than the backside, and the support member 53 is deformed to be convex to the print element substrate side as shown in a broken line in FIG. 3D. Such deformation causes effects of deteriorating adhesiveness of the support member to the print element member to be mounted thereon, and seal properties of a cap member at the time of capping the print element substrate for recovery.

Therefore, the support member 12 in the liquid ejecting head 1 of the present embodiment is, as illustrated in FIG. 2D, configured such that the plate thickness of the support member 12 is different between the plate thickness of t2 in the adhesion part and the plate thickness of t1 of the main surface other than the adhesion part. Specifically the plate thickness of t2 in the adhesion part corresponding to a region of the support member 12 where the adhesive is coated for bonding the print element substrate 11 thereon is made thinner than the plate thickness of t1 of the main surface other than the adhesion part. At this time, a step part (recessed part) formed between the adhesion part and the main surface other than the adhesion part is provided to the adhesion surface side of the print element substrate 11 such that the ejection opening surface side of the print element substrate 11 is substantially equal in height to or does not protrude from the surface of the support member 12 at the time of bonding the print element substrate 11. In this manner, a breakage of the print element substrate 11 at the falling-down of the liquid ejecting head 1 is suppressed.

Figure 4A:
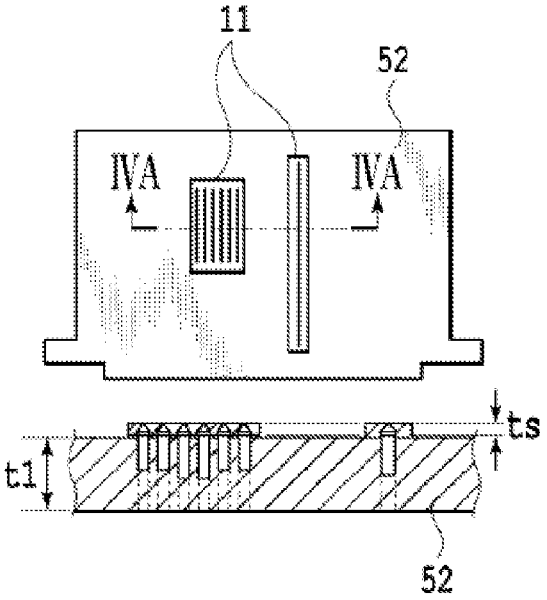
FIG. 4A is a front view illustrating a support member in a comparative example 1 and a sectional view taken in a direction of arrows IVA-IVA in the front view.
Figure 4B:
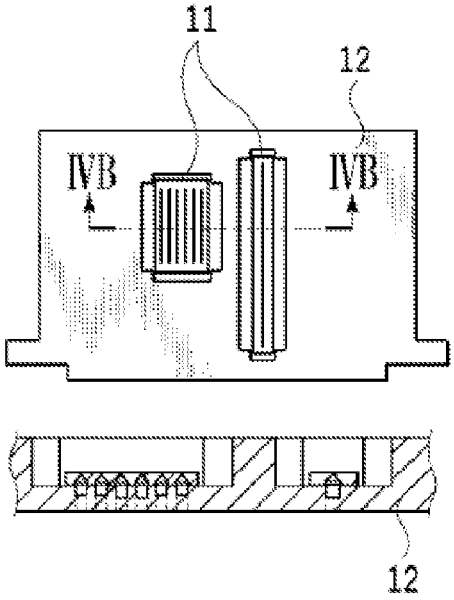
FIG.4B PRIOR ART
FIG. 4B is a front view illustrating the support member in the first embodiment and a sectional view taken in a direction of arrows IVB-IVB in the front view.
Figure 4C:
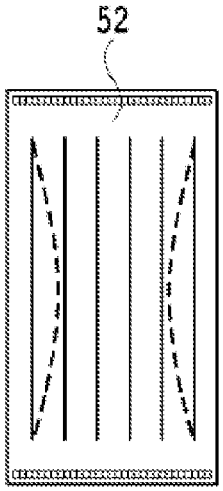
FIG. 4C is a drawing illustrating a state where the support member in the comparative example 1 contracts.
Figure 4D:
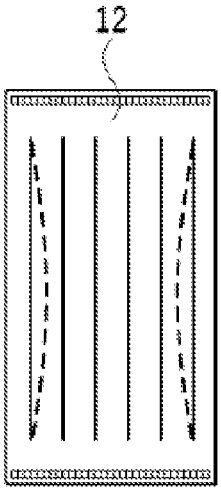
FIG. 4D is a drawing illustrating a state where the support member in the first embodiment contracts.
Figure 5A:
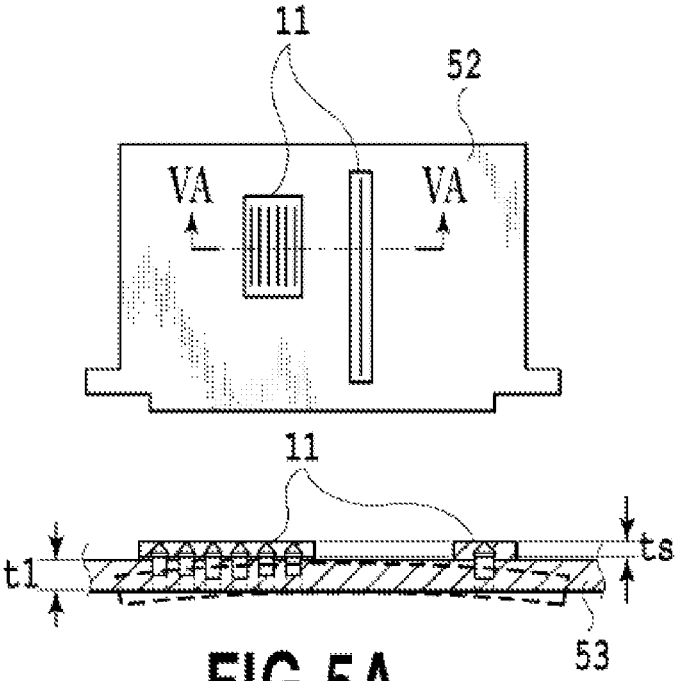
FIG. 5A is a front view illustrating the conventional support member in the comparative example 1 and a sectional view taken in a direction of arrows VA-VA in the front view.
Figure 5B:
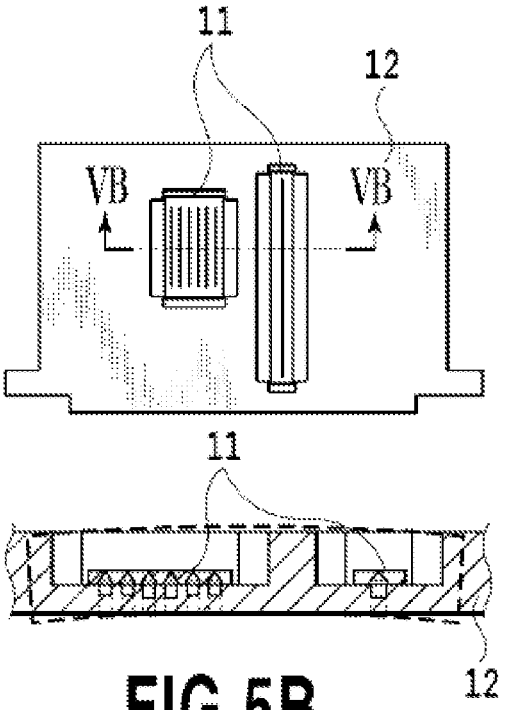
FIG. 5B is a front view illustrating the support member in the first embodiment and a sectional view taken in a direction of arrows VB-VB in the front view.

FIG. 4A to FIG. 4D, FIG. 5A and FIG. 5B are drawings for explaining the effect of the present invention, wherein FIG. 4A, FIG. 4C and FIG. 5A are drawings illustrating a comparative example, and FIG. 4B, FIG. 4D and FIG. 5B are drawings illustrating the present embodiment. As illustrated in FIG. 48, by making the plate thickness of t2 in the adhesion part of the support member 12 thinner than the plate thickness of t1 in the surroundings to reduce the volume of the resin of t2 part, the stress to be generated by the resin of t2 part is also reduced. Therefore the force with which the support member 12 contracts by heat curing/contraction is weakened, making it possible to reduce the tension stress to be loaded on each supply opening.

As seen by comparing the support member 52 in the comparative example in FIG. 4C with the support member 12 in the present embodiment in FIG. 4D, it is seen that the tension stress loaded on the ink supply opening of the supply member 12 is reduced. In this manner, a deflection amount of the ink supply opening in the support member 12 to the inside can be also reduced, and as a result, the occurrence of the crack in the corner part P of the ink supply opening can be suppressed.

As illustrated in FIG. 5B, since the main surface other than the adhesion part is configured to be thicker than the plate thickness of the adhesion part, second moment of area in the support member 12 is increased as compared to a case of the uniformly thin support member 52 in the comparative example (FIG. 5A) to increase the stiffness to the bending generated in curing/contraction of the adhesive. That is, as shown in a broken line in FIG. 5B, the deformation (deflection) of the support member 12 can be reduced to reduce the tension stress loaded on the print element substrate in a short direction due to the deflection.

In this manner, the plate thickness of the adhesion part in the support member 12 is made thinner than the plate thickness of the main surface other than the adhesion part, and therefore the liquid ejecting head and the support member that can achieve both of breakage avoidance of the print element substrate 11 and deformation suppression of the support member 12 can be realized.

Second Embodiment

Hereinafter, a second embodiment in the present invention will be explained with reference to the accompanying drawings. It should be noted that since the basic configuration of the present embodiment is identical to that of the first embodiment, hereinafter only a characteristic configuration thereof will be explained.

In a case of manufacturing the support member 12 by injection molding, when the plate thickness of the main surface other than the adhesion part is made thick totally, there are some cases where there occur void or sinkage of a local resin due to a difference in temperature between a center part and a surface part of the resin at curing in injection molding, entire deformation of the support member by residual stress remaining after the molding, and the like. Therefore for suppressing occurrence of the sinkage or deformation, it is preferable to reduce the volume of the resin of the support member 12, as well as make the thickness of the entire support member uniform.

Figure 6A:
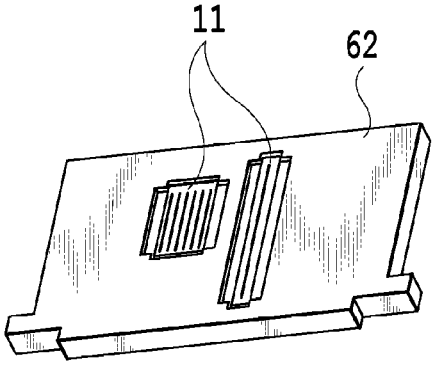
FIG. 6A is a perspective view illustrating a front surface of a support member according to a second embodiment in the present invention.
Figure 6B:
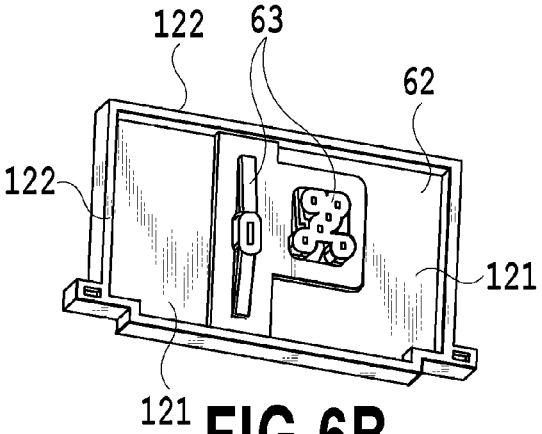
FIG. 6B is a perspective view illustrating a back surface of the support member according to the second embodiment.
Figure 6C:
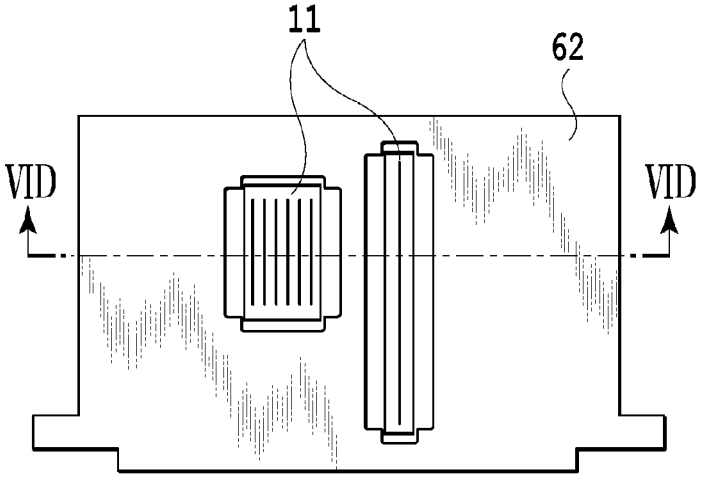
FIG. 6C is a front view illustrating the support member according to the second embodiment.
Figure 6D:
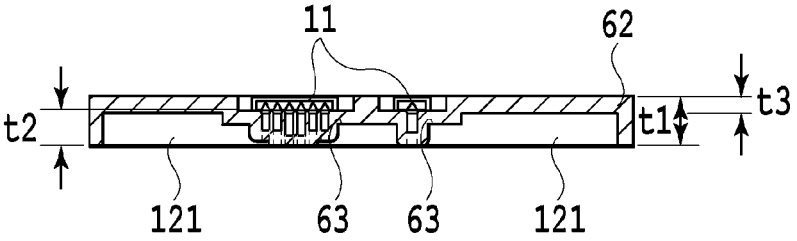
FIG. 6D is a sectional view illustrating the support member, taken in a direction of arrows VID-VID in FIG. 6C.

FIG. 6A to FIG. 6D are drawings illustrating a support member 62 in the present embodiment. FIG. 6A is a perspective view illustrating a front surface of the support member 62, FIG. 6B is a perspective view illustrating a back surface of the support member 62, FIG. 6C is a front view illustrating the support member 62, and FIG. 6D is a sectional view taken in a direction of arrows VID-VID in FIG. 6C. In the present embodiment, as illustrated in FIG. 6B, lightening parts 121 are provided on the back surface of the support member 62. The lightening parts 121 are preferably formed such that first ribs 122 that are thicker than the thickness of the lightening parts 121 and to which an outer edge part of the support member 62 is continuously connected are left and the thickness of the support member 62 other than the first ribs 122 is made substantially uniform. The thickness of the lightening part 121 in the present embodiment is made to the thickness of t3 that is thinner than the plate thickness of t2 of an adhesion part 63 and the thickness of t1 of the first rib 122.

That is, the support member 62 in the present embodiment has three kinds of plate thicknesses composed of the plate thickness of t1 of the outer edge part, the plate thickness of t2 of the adhesion part and the plate thickness of t3 of the lightening part, and the thickness of each part is made to meet the relation of t1>t2>t3. As a result, the stiffness and surface strength of the entire support member can be ensured by the first ribs 122 provided along the outer periphery of the support member 62, the tension stress to be loaded on the print element substrate 11 can be absorbed by the plate thickness of t2 of the adhesion part, and the lightening part can improve the formability of the support member 62.

In this manner, according to the present embodiment, the volume of the resin can be reduced by providing the lightening parts 121 in the support member 62 to avoid the void, the resin sinkage, and the problem on the molding such as the deformation. In addition, since the plate thickness of t2 of the adhesion part 63 is thinner than the plate thickness of t1 of the outer edge part, the liquid ejecting head and the support member that can achieve both of avoidance of breakage of the print element substrate 11 and the deformation suppression of the support member 63 can be realized.

Third Embodiment

Hereinafter, a third embodiment in the present invention will be explained with reference to the accompanying drawings. It should be noted that since the basic configuration of the present embodiment is identical to that of the first embodiment, hereinafter only a characteristic configuration thereof will be explained.

Figure 7A:
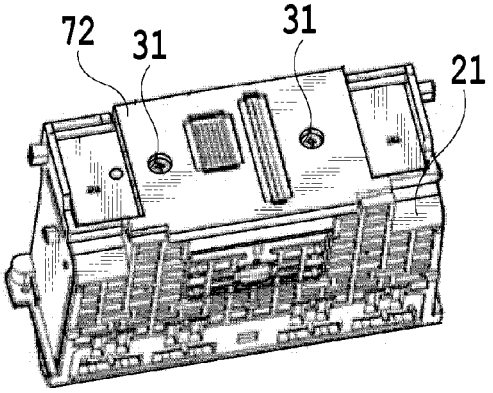
FIG. 7A is a perspective view illustrating a print element head according to a third embodiment in the present invention.
Figure 7B:
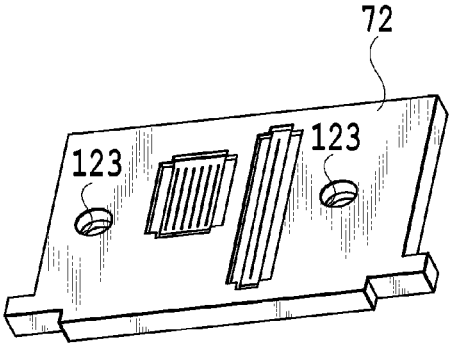
FIG. 7B is a perspective view illustrating a front surface of a support member according to the third embodiment.
Figure 7C:
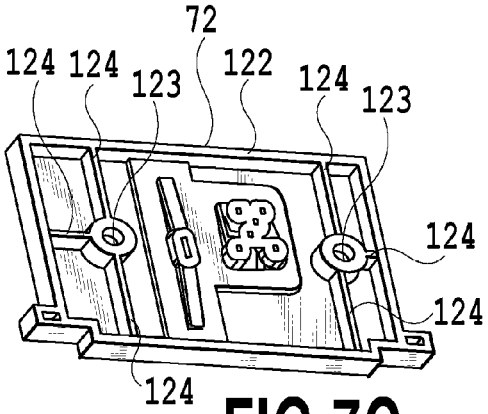
FIG. 7C is a perspective view illustrating a back surface of the support member according to the third embodiment.
Figure 7D:
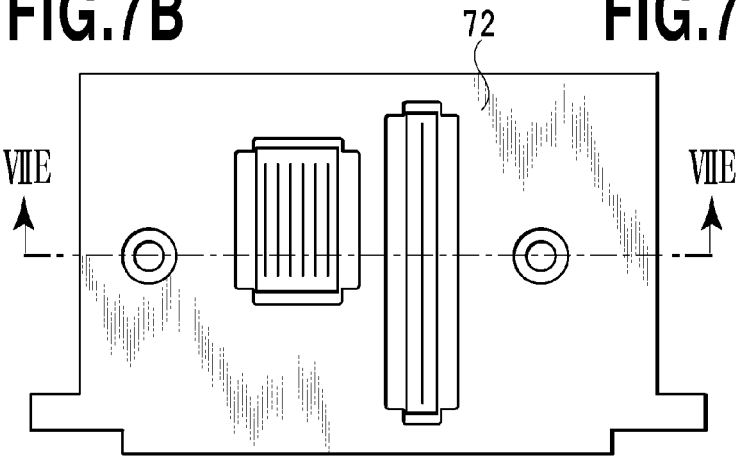
FIG. 7D is a front view illustrating the support member according to the third embodiment.
Figure 7E:
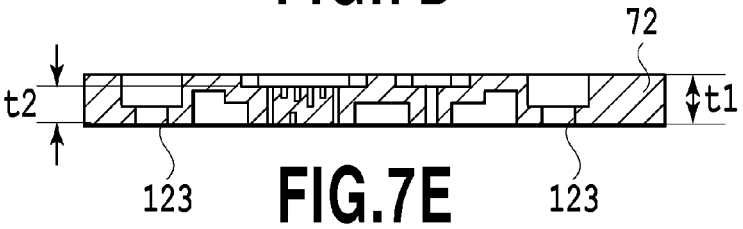
FIG. 7E is a sectional view illustrating the support member, taken in a direction of arrows VIIE-VIIE in FIG. 7D.

FIG. 7A to FIG. 7C are drawings illustrating a third embodiment to which the present invention is applied. FIG. 7A is a perspective view of a liquid ejecting head illustrating a state where a support member 72 is jointed to the housing 21 by screws 31. FIG. 7β is a perspective view illustrating a front surface of the support member 72, FIG. 7C is a perspective view illustrating a back surface of the support member 72, FIG. 7D is a front view illustrating the support member 72, and FIG. 7E is a sectional view taken in a direction of arrows VIIE-VIIE in FIG. 7D. As illustrated in FIG. 7B, the support member 72 is provided with a total of two screwing through holes 123 composed of one hole between the print element substrate 11A and the outer edge part and one hole between the print element substrate 11B and the outer edge part. Since relatively large stress is loaded on this screw fastening part by the screw fastening, a reduction in stiffness of the support member 72 possibly occurs. Therefore according to the present embodiment, as illustrated in FIG. 7C, second ribs 124 are disposed to bridge over between an outer peripheral part of the through hole 123 and the first rib 122 of the outer edge part. The second ribs 124 can act as beams to improve the surface strength of the support member 72.

In this manner, it is possible to suppress the strength reduction due to the through hole provided for screwing by providing the ribs directed at the through hole. Further, since the plate thickness of t2 of the adhesion part is thinner than the plate thickness of t1 of the outer edge part, the liquid ejecting head and the support member that can achieve both of avoidance of breakage of the print element substrate 11 and the deformation suppression of the support member 72 can be realized. It should be note that in the present invention, the fastening between the support member 72 and the housing 21 of the liquid ejecting head is not limited to the screw in the present embodiment, and can include the forms of fixing them by various methods, such as an adhesive or welding.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-112736 filed May 30, 2014, and No. 2015-078008 filed Apr. 6, 2015, which are hereby incorporated by reference herein in their entirety.

What is claimed is:

1. A liquid ejecting head comprising:

a print element substrate that can eject liquids from ejection ports;

a resin-made plate-like support member comprising a first surface which is provided with a first recess having, at a bottom surface, an adhesion part to which the print element substrate is adhered, and a second surface which is a back side of the first surface and which is provided with a second recess, and a housing joined to the second surface of the support member, wherein a thickness of the adhesion part of the support member is thinner than a thickness of an outer edge part of the support member.

2. The liquid ejecting head according to claim 1, wherein a surface of the print element substrate on which the ejection ports are formed at the time of bonding the print element substrate on the bottom surface of the first recess is positioned closer to the bottom surface than the first surface.

3. The liquid ejecting head according to claim 1, wherein the adhesion part is provided with supply openings that supply liquids to the print element substrate.

4. The liquid ejecting head according to claim 3, wherein the adhesion part of the support member includes a first adhesion part provided with a plurality of the supply openings and a second adhesion part provided with one supply opening.

5. The liquid ejecting head according to claim 1, wherein the second recess is thinner than the adhesion part and is provided between the outer edge part and the adhesion part.

6. The liquid ejecting head according to claim 1, wherein the outer edge part is provided with a first rib formed continuously in the outer periphery of the support member.

7. The liquid ejecting head according to claim 6, wherein a through-hole is provided in the second recess, and a second rib is provided to extend toward the through-hole from the first rib.

8. The liquid ejecting head according to claim 7, wherein the through-hole is provided with a screw that fixes the support member and the housing.

9. The liquid ejecting head according to claim 1, wherein the support member is made of a modified PPE resin.

10. The liquid ejecting head according to claim 1, wherein the adhesion part of the support member is thicker than a portion of the support member in which the second recess is provided.

* * * * *